US010329646B2

(12) United States Patent
Daito et al.

(10) Patent No.: US 10,329,646 B2
(45) Date of Patent: Jun. 25, 2019

(54) STEEL WIRE FOR DRAWING

(71) Applicant: NIPPON STEEL & SUMITOMO METAL CORPORATION, Tokyo (JP)

(72) Inventors: Yoshihiro Daito, Kisarazu (JP); Junichi Kodama, Kamaishi (JP); Masashi Sakamoto, Kamaishi (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 135 days.

(21) Appl. No.: 15/503,487

(22) PCT Filed: Aug. 14, 2015

(86) PCT No.: PCT/JP2015/072961
§ 371 (c)(1),
(2) Date: Feb. 13, 2017

(87) PCT Pub. No.: WO2016/024635
PCT Pub. Date: Feb. 18, 2016

(65) Prior Publication Data

US 2017/0241000 A1 Aug. 24, 2017

(30) Foreign Application Priority Data

Aug. 15, 2014 (JP) ..... 2014-165345

(51) Int. Cl.
*C22C 38/02* (2006.01)
*C22C 38/18* (2006.01)
(Continued)

(52) U.S. Cl.
CPC ..... *C22C 38/32* (2013.01); *C22C 38/00* (2013.01); *C22C 38/001* (2013.01);
(Continued)

(58) Field of Classification Search
CPC ..... C22C 38/02; C22C 38/18; C22C 38/32
(Continued)

(56) References Cited

U.S. PATENT DOCUMENTS

2005/0087270 A1 4/2005 Nagao et al.
2010/0263772 A1 10/2010 Lee
(Continued)

FOREIGN PATENT DOCUMENTS

CN 101208445 A 6/2008
CN 101331243 A 12/2008
(Continued)

OTHER PUBLICATIONS

Extended European Search Report dated Jan. 2, 2018, in European Patent Application No. 15831535.8.
(Continued)

*Primary Examiner* — Brian D Walck
(74) *Attorney, Agent, or Firm* — Birch, Stewart, Kolasch & Birch, LLP

(57) ABSTRACT

A steel wire for drawing includes, as a chemical composition, by mass %: C: 0.9% to 1.2%, Si: 0.1% to 1.0%, Mn: 0.2% to 1.0%, and Cr: 0.2% to 0.6%, limits Al, N, P, and S to be predetermined ranges, and includes one or more selected from the group consisting of Mo: 0% to 0.20%, and B: 0% to 0.0030%, a remainder of Fe and impurities; in which a metallographic structure includes pearlite, a volume fraction of the pearlite is 95% or higher, an average lamellar spacing of the pearlite is 50 nm to 75 nm, an average length of cementite in the pearlite is 2.0 μm to 5.0 μm, and a ratio of the number of grains of cementite with a length of 0.5 μm or smaller to the cementite in the pearlite is 20% or lower.

2 Claims, 1 Drawing Sheet

(51) Int. Cl.

| | |
|---|---|
| ***C22C 38/32*** | (2006.01) |
| ***C22C 38/00*** | (2006.01) |
| ***C22C 38/04*** | (2006.01) |
| ***C22C 38/06*** | (2006.01) |
| ***C22C 38/22*** | (2006.01) |
| *C21D 8/06* | (2006.01) |
| *C21D 9/52* | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/18* (2013.01); *C22C 38/22* (2013.01); *C21D 8/06* (2013.01); *C21D 9/525* (2013.01); *C21D 2211/009* (2013.01)

(58) Field of Classification Search
USPC ..... 148/320
See application file for complete search history.

(56) References Cited

U.S. PATENT DOCUMENTS

| | | | | |
|---|---|---|---|---|
| 2011/0168302 | A1 | 7/2011 | Takahashi et al. | |
| 2012/0318410 | A1 | 12/2012 | Tarui et al. | |
| 2013/0216423 | A1* | 8/2013 | Oura ..... | C21D 8/065 420/99 |

FOREIGN PATENT DOCUMENTS

| | | | |
|---|---|---|---|
| EP | 2 083 094 | A1 | 7/2009 |
| JP | 6-49592 | A | 2/1994 |
| JP | 6-158223 | A | 6/1994 |
| JP | 2000-256740 | A | 9/2000 |
| JP | 2000-355736 | A | 12/2000 |
| JP | 2002-146479 | A | 5/2002 |
| JP | 2004-91912 | A | 3/2004 |
| JP | 2005-126765 | A | 5/2005 |
| JP | 2005-163082 | A | 6/2005 |
| JP | 2008-208450 | A | 9/2008 |
| JP | 2008-261028 | A | 10/2008 |
| JP | 2013-510234 | A | 3/2013 |
| KR | 10-0711469 | B1 | 4/2007 |
| KR | 10-1359064 | B1 | 2/2014 |
| WO | WO 2010/150450 | A1 | 12/2010 |
| WO | WO 2011/055919 | A2 | 5/2011 |
| WO | WO 2011/126073 | A1 | 10/2011 |

OTHER PUBLICATIONS

Office Action dated Dec. 26, 2017, in Chinese Patent Application No. 201580043290.0, with English Search Report.
International Search Report for PCT/JP2015/072961 dated Nov. 17, 2015.
Written Opinion of the International Searching Authority for PCT/JP2015/072961 (PCT/ISA/237) dated Nov. 17, 2015.
Korean Notice of Allowance, dated Sep. 5, 2018, for Korean Application No. 10-2017-7003505, along with an English translation.

* cited by examiner

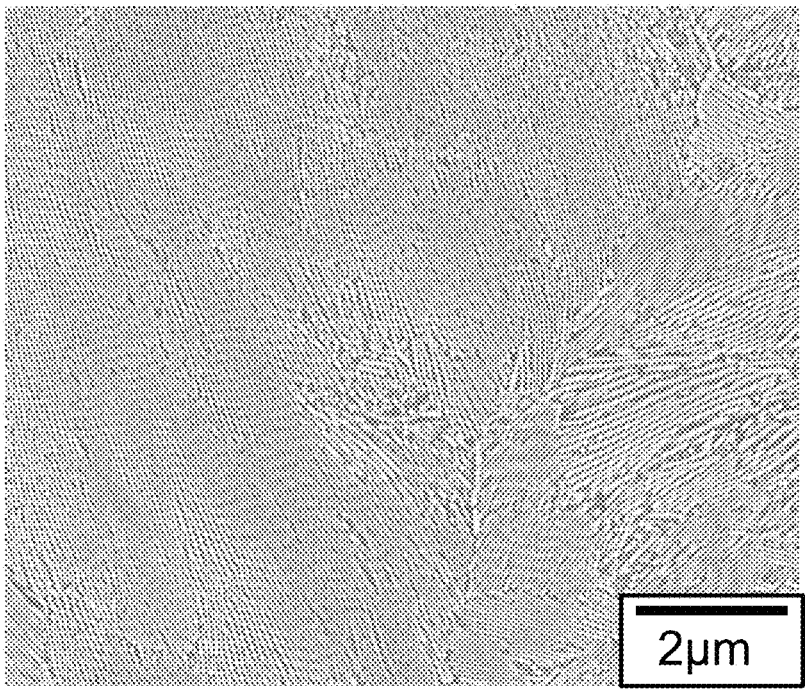
2μm

STEEL WIRE FOR DRAWING

TECHNICAL FIELD OF THE INVENTION

For example, a steel cord or a sawing wire is used as a reinforcing wire of a radial tire of a vehicle or reinforcing materials of various industrial belts or hoses. Within a material for producing a high strength steel wire having a small diameter of 0.15 mm to 0.40 mm, such as the steel cord or the sawing wire, a steel wire, which was subjected to a final heat treatment, is called a steel wire for drawing in the present invention.

In addition, a high strength steel wire having a small diameter of 0.15 mm to 0.40 mm is generally called an extra fine steel wire.

The present invention relates to a steel wire for drawing which is appropriate as a material for the extra fine steel wire mentioned above.

Priority is claimed on Japanese Patent Application No. 2014-165345, filed on Aug. 15, 2014, the content of which is incorporated herein by reference.

Hereinafter, there may be cases where a "high strength steel wire having a small diameter of 0.15 mm to 0.40 mm" is simply called an "extra fine steel wire".

RELATED ART

An extra fine steel wire used as a steel cord, which is used as reinforcing materials of a radial tire of a vehicle, various industrial belts or hoses, a sawing wire or the like is generally produced according to the following method.

First, a steel piece is hot rolled into a steel wire rod having a diameter of 5 mm to 6 mm and is thereafter subjected to controlled cooling.

Hereinafter, there may be cases where the diameters of a steel wire rod, a steel wire, and a steel wire for drawing are referred to as wire diameters and a "steel wire rod" is simply referred to as a "wire rod".

Next, the steel wire rod is primarily drawn into a wire diameter of 3 mm to 4 mm and is subjected to a heat treatment called a patenting treatment so as to be formed into an intermediate steel wire. In addition, the intermediate steel wire is secondarily drawn into a wire diameter of 1 mm to 2 mm, and a steel wire for drawing is obtained through a final patenting treatment.

In addition, a brass plating treatment is performed on the obtained steel wire for drawing, and the steel wire for drawing subjected to the brass plating treatment is formed into an extra fine steel wire having a wire diameter of 0.15 mm to 0.40 mm through wet drawing, which is the final drawing.

For example, a plurality of the extra fine steel wires produced as described above are further twisted to be formed into a "stranded steel wire" and become a steel cord or the like.

Here, the patenting treatment is the following method as generally well known.

First, the patenting treatment is a treatment in which a steel wire rod or a steel wire is heated to an austenite temperature range to transform the entire metallographic structure into an austenitic structure, is thereafter immersed into a lead bath, a fluidized bed, or the like whose temperature is held at a temperature of an $A_1$ transformation point or less for rapid cooling to a temperature range in which a pearlitic structure is mainly formed, and is held in this temperature range for a predetermined time.

In addition, in the present invention, the "steel wire for drawing" means a steel wire after being subjected to a heat treatment represented by the patenting treatment described above, or in a case where a plurality of patenting treatments are performed, a steel wire for drawing in a stage of after being subjected to the final patenting treatment to obtain a metallographic structure in which a pearlitic structure is mainly formed and before being subjected to final wet drawing into a wire diameter required for an extra fine steel wire used for a steel cord or a sawing wire.

In recent years, for various purposes such as a reduction in the weight of a tire and a reduction in cutting margin during cutting of a silicon wafer, there has been an increasing demand for a reduction in the weight of a steel cord, a sawing wire, or the like.

Therefore, various products such as the steel cord, sawing wire mentioned above, and the like require higher strength, and this requirement cannot be met unless alloy elements, which contribute to the improvement in tensile strength, are included.

Due to this situation, alloy elements such as Cr, which contribute to the improvement in tensile strength, are added so that an extra fine steel wire ensures high strength.

However, the current situation is that when alloy elements such as Cr are added to achieve high-strengthening, longitudinal cracking called delamination in a torsion test, which is an indication of the occurrence of cracking during twisting, is likely to occur.

Therefore, even when high-strengthening is achieved, an extra fine steel wire in which delamination is not occurred is strongly desired.

To meet this desire, for example, techniques described in Patent Documents 1 to 4 mentioned below have been proposed. In addition, all of a "high carbon steel wire rod" in Patent Document 1, a "wire rod for drawing" in Patent Document 2, and a "high carbon steel wire" in Patent Document 3 include a steel wire in the same stage as that of the "steel wire for drawing" of the present invention described above.

Patent Document 1 discloses a high carbon steel wire rod which includes C: 0.88% to 1.10% and the like, further includes one or two of B: 0.0050% or less and Nb: 0.020% or less, and includes free N in an amount of less than 0.0005%.

However, in the technique of Patent Document 1, due to the addition of B or Nb, coarse nitrides of B and carbonitrides of Nb are likely to form, and as a result, there is concern that the wire rod may be broken during drawing.

Therefore, the technique of Patent Document 1 is not satisfactory for stable production.

Patent Document 2 discloses a wire rod for drawing having excellent torsion properties, which is made of eutectoid steel or hypereutectoid steel, includes 80% or more of pearlite, and the maximum length of ferrite forming a secondary phase is 10 μm or smaller.

However, as described as "by controlling the austenite grain size and the amount of undissolved carbides" in paragraph [0015] in Patent Document 2, undissolved carbides are used in the technique of Patent Document 2. Accordingly, coarse carbides are likely to remain in a center segregation part.

Therefore, in the technique of Patent Document 2, breaking of the wire rod is likely to occur during final wet drawing, and the technique of Patent Document 2 is thus not satisfactory for stable production.

Patent Document 3 discloses a high carbon steel wire having excellent longitudinal cracking resistance, in which the primary phase is pearlite, and the area fraction of ferrite in a surface part from the surface to a depth of 50 μm is 0.40% or less.

However, regarding mass production, since a hot rolled wire rod as a material is cooled in a state of overlapping in a coil shape after finish rolling, a cooling rate and an atmosphere varies depending on locations. As a result, a decarburized layer is formed inhomogeneously, and even in the technique of Patent Document 3, it is difficult to stably implement this metallographic structure over the overall length and the overall circumference of a steel wire for drawing.

Therefore, the technique of Patent Document 3 is not satisfactory for stable production.

Patent Document 4 discloses a steel wire rod which includes C: 0.90% to 1.10% and Cr: 0.2% to 0.6%, in which the pearlite block size is adjusted to be austenite grain size numbers 6 to 8 in a steel, the amount of generated proeutectoid cementite is adjusted to be 0.2% or less in terms of volume fraction, the thickness of cementite in pearlite is adjusted to be 20 nm or smaller, and the concentration of Cr contained in the cementite is adjusted to be 1.5% or lower.

However, provided techniques regarding claim 1 and claim 2 of Patent Document 4 omit a patenting treatment performed when a wire diameter is 3 mm to 4 mm. In addition, although a method of producing a high strength steel wire having a small diameter is described in claim 3, final heat treatment conditions and a metallographic structure after a final heat treatment are not specified. The metallographic structure after the final heat treatment is not described even in the detailed description.

PRIOR ART DOCUMENTS

Patent Documents

[Patent Document 1] Japanese Unexamined Patent Application, First Publication No. 2005-163082

[Patent Document 2] Japanese Unexamined Patent Application, First Publication No. 2002-146479

[Patent Document 3] Japanese Unexamined Patent Application, First Publication No. 2000-355736

[Patent Document 4] Japanese Unexamined Patent Application, First Publication No. 2004-91912

DISCLOSURE OF THE INVENTION

Problems to be Solved by the Invention

The present invention has been realized by taking the above described circumstances into consideration as the background, and an object thereof is to provide a steel wire for drawing, which is appropriate as a steel wire used as a material for producing a high strength steel wire having a small diameter such as a steel cord or a sawing wire, can be more stably produced, and has excellent drawability.

By performing wet drawing as final drawing on the steel wire for drawing of the present invention, a steel wire having a tensile strength of, for example, 4200 MPa or higher and excellent torsion properties can be obtained.

Means for Solving the Problem

In order to solve the problems and obtain a steel wire for drawing, which can be stably produced and has excellent drawability, the inventors repeatedly examined and studied an effect of the chemical composition and microstructure of a steel wire for drawing on the tensile strength and torsion properties of an extra fine steel wire after the final wet drawing.

As a result, the following knowledge (a) to (d) was obtained.

Here, there may be cases where an "extra fine steel wire after final wet drawing" is simply called a "steel wire after drawing".

(a) A steel wire after drawing is high strengthened by including Cr or increasing the Si content or the Mn content. However, due to the high strengthening, delamination easily occurs in a torsion test.

(b) The length of cementite in pearlite decreases by including Cr or increasing the Si content or the Mn content. Particularly, there is a tendency toward an increase in the amount of cementite having a shape close to a granular shape with a length of 0.5 μm or smaller. As described above, when the length of cementite in pearlite decreases, and particularly the amount of cementite having a shape close to a granular shape with a length of 0.5 μm or smaller increases, delamination is likely to occur in a torsion test of a steel wire after drawing.

(c) However, even when the amount of alloy elements such as Cr is increased, a pearlitic transformation temperature can be controlled by controlling the temperature and immersion time of a lead bath or a fluidized bed during a patenting treatment. When the pearlitic transformation temperature is increased, the length of cementite in pearlite does not become too short, and the amount of cementite having a shape close to a granular shape with a length of 0.5 μm or smaller is not significantly increased. Therefore, delamination is less likely to occur in a torsion test of the steel wire after drawing.

(d) On the other hand, when the pearlitic transformation temperature is increased, the lamellar spacing of pearlite increases, and thus the tensile strength of the steel wire for drawing decreases. Therefore, in order to achieve high strengthening and torsion properties of the steel wire after drawing to be compatible with each other, the pearlitic transformation temperature needs to be adjusted to an appropriate range. In addition, after the pearlitic transformation is completed, when the steel wire is held at 550° C. or higher in a temperature range in which Fe atoms diffuse long ranges, spheroidizing of cementite proceeds. Therefore, temperature management after the pearlitic transformation is completed is necessary.

On the basis of the knowledge (a) to (d), the inventors repeatedly conducted further experiments and research in detail.

As a result, by appropriately adjusting or limiting the amount of alloy elements and impurity elements in steel and simultaneously adjusting conditions of a metallographic structure mainly containing pearlite, particularly the volume fraction of pearlite, the average lamellar spacing of pearlite, the average length of cementite in pearlite, and the proportion of the number of grains of cementite with a length of 0.5 μm or smaller in pearlite to be respectively in appropriate ranges, a steel wire for drawing, which can solve the above described problems and is used as the material of a high strength steel wire having a small diameter, is obtained.

In addition, it was found that by using a steel wire for drawing that satisfies the above described characteristics as a material, the high strength steel wire having a small diameter as a final product can have a tensile strength of, for example, 4200 MPa or higher and can simultaneously have excellent torsion properties.

Furthermore, the inventors found that a steel wire after drawing, that is, an extra fine steel wire after final wet drawing can be stably produced even in a mass production process while securing high strength and excellent torsion properties and completed the present invention.

The present invention has been made on the basis of this knowledge, and the gist thereof is as follows.

(1) According to an aspect of the present invention, a steel wire for drawing includes, as a chemical composition, by mass %, C: 0.9% to 1.2%, Si: 0.1% to 1.0%, Mn: 0.2% to 1.0%, Cr: 0.2% to 0.6%, Al: limited to 0.002% or less, N: limited to 0.007% or less, P: limited to 0.02% or less, S: limited to 0.01% or less, one or more selected from the group consisting of Mo: 0% to 0.20%, and B: 0% to 0.0030%, and a remainder of Fe and impurities, in which a metallographic structure includes a pearlite, and a volume fraction of the pearlite is 95% or higher, an average lamellar spacing of the pearlite is 50 nm to 75 nm, an average length of cementite in the pearlite is 2.0 μm to 5.0 μm, and a ratio of the number of grains of cementite with a length of 0.5 μm or smaller to the cementite in the pearlite is 20% or lower.

(2) The steel wire for drawing described in (1) may include, as the chemical composition, by mass %, one or more selected from the group consisting of Mo: 0.02% to 0.20%, and B: 0.0005% to 0.0030%.

Effects of the Invention

According to the aspect of the present invention, the steel wire for drawing which is used as the material of a high strength steel wire having a small diameter, which is appropriately used as a steel cord or a sawing wire and has high strength and excellent torsion properties, can be stably produced with high productivity.

As a result, very useful industrial effects are exhibited.

BRIEF DESCRIPTION OF THE DRAWINGS

FIG. 1 is a metallographic structure photograph of a cross section of a steel wire for drawing according to the aspect of the present invention, which is perpendicular to the longitudinal direction thereof and is taken at an arbitrary position at a magnification of 10,000-fold using an FE-SEM.

EMBODIMENT OF THE INVENTION

A steel wire for drawing according to an embodiment will be described.

First, the reason for limiting the composition of chemical components of the steel wire for drawing in the embodiment will be described in more detail. In the following description, % means mass %.

C: 0.9% to 1.2%

C is an element effective in increasing the tensile strength of a steel wire after drawing.

In a case where the C content is less than 0.9%, for example, it is difficult to stably impart, for example, a tensile strength as high as 4200 MPa to the steel wire after drawing. Therefore, the lower limit of the C content is set to 0.9%. After drawing, in order to stably obtain a high strength steel wire, it is effective to increase the C content. In order to obtain a tensile strength of 4500 MPa or higher, the C content is preferably 1.0% or more.

On the other hand, when the C content is excessive, a structure becomes hard, resulting in a deterioration in drawability or torsion properties. Particularly, when the C content is more than 1.2%, it is industrially difficult to suppress the formation of cementite precipitated along prior austenite grain boundaries, that is, proeutectoid cementite, and the drawability or torsion properties are significantly deteriorated. Therefore, the upper limit of the C content is set to 1.2%.

Si: 0.1% to 1.0%

Si is an element effective in increasing the tensile strength of the steel wire after drawing and is a necessary element as a deoxidizer.

When the Si content is less than 0.1%, the effect obtained by including Si cannot be sufficiently obtained. Therefore, the lower limit of the Si content is set to 0.1%. After drawing, in order to stably obtain a high strength steel wire, it is effective to increase the Si content. In order to obtain a tensile strength of 4500 MPa or higher, the Si content is preferably 0.2% or more.

On the other hand, when the Si content is more than 1.0%, the torsion properties of the steel wire after drawing deteriorate. Therefore, the upper limit of the Si content is set to 1.0%. However, since Si is an element which affects the hardenability of the steel wire for drawing or the formation of proeutectoid cementite, the Si content is preferably 0.5% or less from the viewpoint of stably securing a desired microstructure in the steel wire for drawing.

Mn: 0.2% to 1.0%

Mn is a component having an effect of fixing S in steel as MnS and preventing hot brittleness in addition to an effect of increasing the tensile strength of the steel wire after drawing.

However, when the Mn content is less than 0.2%, the effects cannot be sufficiently obtained. Therefore, the lower limit of the Mn content is set to 0.2%. After drawing, in order to stably obtain a high strength steel wire, it is effective to increase the Mn content. In order to obtain a tensile strength of 4500 MPa or higher, the Mn content is preferably 0.3% or more.

On the other hand, Mn is element that is likely to segregate. Particularly, when the Mn content is more than 1.0%, Mn segregates in the central part of the steel wire. Martensite or bainite is formed in the segregation part, and the drawability of the steel wire for drawing in a wet drawing process, which is a final drawing process, deteriorates. Therefore, the upper limit of the Mn content is set to 1.0%. However, since Mn is an element which affects the hardenability of the steel wire for drawing or the formation of proeutectoid cementite, the Mn content is preferably 0.5% or less from the viewpoint of stably securing a desired microstructure in the steel wire for drawing.

Cr: 0.2% to 0.6%

Cr has an effect of decreasing the lamellar spacing of pearlite and increasing the tensile strength of the steel wire after drawing.

When the Cr content is less than 0.2%, the tensile strength of the steel wire after drawing cannot be 4200 MPa or higher. Therefore, the lower limit of the Cr content is set to 0.2%. In order to more stably obtain this effect, the Cr content is preferably 0.3% or more.

However, when the Cr content is more than 0.6%, the torsion properties of the steel wire after drawing deteriorate. Therefore, the upper limit of the Cr content is set to 0.6%. More specifically, the Cr content is 0.4% or less.

Furthermore, regarding the steel wire for drawing according to the embodiment, Al, N, P, and S need to be limited as follows.

Al: 0.002% or Less

Al is an element that forms oxide-based inclusions primarily containing $Al_2O_3$ and deteriorates the drawability of the steel wire for drawing.

Particularly, when the Al content is more than 0.002%, the oxide-based inclusions are coarsened and breaking of the steel wire occurs frequently during drawing. As a result, a deterioration in the drawability of the steel wire for drawing becomes significant in the wet drawing process, which is the final drawing process.

Therefore, the Al content is limited to 0.002% or less. The Al content is preferably 0.0015% or less.

In addition, the lower limit of the Al content includes 0%. However, in consideration of current refining technologies and production costs, the lower limit of the Al content is preferably 0.0001%.

N: 0.007% or Less

N is an element which adheres to dislocation during cold drawing and thus increases the tensile strength of the steel wire after drawing, but deteriorates the drawability of the steel wire for drawing.

Particularly, when the N content is more than 0.007%, a deterioration in the drawability of the steel wire for drawing becomes significant in the wet drawing process, which is the final drawing process. Therefore, the N content is limited to 0.007% or less. The N content is preferably 0.006% or less.

In addition, the lower limit of the N content includes 0%. However, in consideration of current refining technologies and production costs, the lower limit of the N content is preferably 0.0001%.

P: 0.02% or Less

P is an element that segregates in grain boundaries and deteriorates the drawability of the steel wire for drawing.

Particularly, when the P content is more than 0.02%, a deterioration in the drawability of the steel wire for drawing becomes significant in the wet drawing process, which is the final drawing process.

Therefore, the P content is limited to 0.02% or less. The P content is preferably 0.015% or less.

In addition, the lower limit of the P content includes 0%. However, in consideration of current refining technologies and production costs, the lower limit of the P content is preferably 0.001%.

S: 0.01% or Less

Like P, S is an element that deteriorates the drawability of the steel wire for drawing.

Particularly, when the S content is more than 0.01%, a deterioration in the drawability of the steel wire for drawing becomes significant in the wet drawing process, which is the final drawing process.

Therefore, the S content is limited to 0.01% or less.

In addition, the lower limit of the S content includes 0%. However, in consideration of current refining technologies and production costs, the lower limit of the S content is preferably 0.001%.

The above elements are base elements of the steel wire for drawing according to the embodiment, and the remainder is Fe and impurities. In addition, "impurities" in "the remainder is Fe and impurities" indicate those unavoidably incorporated from ore and scrap as raw materials and production environments when steel wire for drawing is industrially produced.

However, in addition to the base elements, the steel wire for drawing in the embodiment may include, instead of a portion of Fe in the remainder, one or more selected from the group consisting of Mo and B.

Mo: 0% to 0.20%

The addition of Mo is arbitrary, and thus, the lower limit of the Mo content is 0%.

However, by the addition of Mo, an effect of enhancing the balance between the tensile strength and the torsion properties of the steel wire after drawing can be more stably exhibited. In order to obtain this effect, the Mo content is preferably set to 0.02% or more. From the viewpoint of obtaining the balance between the tensile strength and the torsion properties of the steel wire after drawing, the Mo content is more preferably set to 0.04% or more.

On the other hand, when the Mo content is more than 0.20%, martensite is likely to form in steel, and there may be a case where the drawability of the steel wire for drawing deteriorates in the wet drawing process, which is the final drawing process.

Therefore, the upper limit of the Mo content is preferably 0.20%. The Mo content is more preferably 0.10% or less.

B: 0% to 0.0030%

The addition of B is arbitrary, and thus, the lower limit of the B content is 0%.

However, B is bonded to N solute in steel to form BN and thus has an effect of reducing the amount of solid soluted N. Therefore, by the addition of B, the drawability of the steel wire for drawing can be improved in the wet drawing process, which is the final drawing process. In order to obtain this effect, 0.0005% or more of B is preferably added. The B content is more preferably 0.0007% or more.

On the other hand, when the B content is more than 0.0030%, coarse carbides are likely to form in a wire rod, and there may be a case where the drawability of the steel wire for drawing deteriorates in the wet drawing process, which is the final drawing process. Therefore, the upper limit of the B content is preferably 0.0030%. The upper limit of the B content is more preferably 0.0020%.

In the steel wire for drawing in the embodiment, since Ti and Zr, whose amounts are more than the amounts that incorporated as impurities, are likely to form coarse nitrides during casting and remain in the wire rod, and thus, deteriorate the drawability of the steel wire for drawing, it is preferable that Ti and Zr are not actively added instead of a portion of Fe in the remainder.

Next, the metallographic structure of the steel wire for drawing according to the embodiment will be described.

<Volume Fraction of Pearlite: 95% or Higher>

As illustrated in FIG. 1, the metallographic structure of the steel wire for drawing according to the embodiment includes pearlite having a lamellar structure in which ferrite and cementite are layered.

When the volume fraction of the pearlite is lower than 95% in the steel wire for drawing, high strength that a tensile strength is 4200 MPa or higher cannot be secured and the occurrence of delamination in a torsion test also cannot be suppressed in the steel wire after drawing. Therefore, the volume fraction of the pearlite in the steel wire for drawing needs to be 95% or higher. In order to more stably achieve the high strength and the torsion properties of the steel wire after drawing to be compatible with each other, the volume fraction of the pearlite in the steel wire for drawing is preferably set to 98% or higher. The volume fraction of the pearlite in the steel wire for drawing may be 100%.

On the other hand, in the steel wire for drawing according to the embodiment, the metallographic structure other than the pearlite, that is, the metallographic structure of the remainder is consisted of one or more selected from the group consisting of cementite, ferrite, and bainite. In the steel wire for drawing, the total volume fraction of the metallographic structure other than the pearlite is lower than 5%. In the steel wire for drawing, the metallographic structure of the remainder other than the pearlite is preferably lower than 2%, and may also be 0%.

<Measurement Method of Volume Fraction of Pearlite>

The volume fraction of the pearlite according to the embodiment can be measured according to the following method.

First, a transverse cross section of the steel wire for drawing, that is, a cut surface of the steel wire for drawing perpendicular to the length direction thereof is mirror-polished.

Thereafter, the mirror-polished cut surface is corroded by a picral, and 10 points at arbitrary position are photographed at a magnification of 5,000-fold using a field emission scanning electron microscope (FE-SEM). The area per one visual field is $3.6\times10^{-4}$ $mm^2$ of 18 μm in length and 20 μm in width.

Next, the area fraction of the metallographic structure other than the pearlite is obtained through typical image analysis using the taken photographs. Since the area fraction is the same as the volume fraction, a value obtained by subtracting the area fraction of the metallographic structure other than the pearlite from 100 is determined as the volume fraction of the pearlite in the corresponding visual field. In addition, by averaging the volume fractions of pearlite in the obtained 10 visual fields, the volume fraction of the pearlite of the steel wire for drawing is obtained.

<Average Lamellar Spacing of Pearlite: 50 nm to 75 nm>

When the average lamellar spacing of the pearlite of the steel wire for drawing is greater than 75 nm, high strength that a tensile strength is 4200 MPa or higher cannot be stably obtained in the steel wire after drawing, which becomes a final product. Therefore, the average lamellar spacing of the pearlite in the steel wire for drawing is set to 75 nm or smaller. In order to achieve the high strength and the torsion properties of the steel wire after drawing to be compatible with each other, the average lamellar spacing of the pearlite in the steel wire for drawing is preferably set to 70 nm or smaller.

On the other hand, when the average lamellar spacing of the pearlite in the steel wire for drawing is smaller than 50 nm, breaking occurs during final wet drawing, and the steel wire after drawing cannot be obtained. Therefore, the average lamellar spacing of the pearlite of the steel wire for drawing is set to 50 nm or greater. More stably, in order not to cause the breaking during drawing, the average lamellar spacing of the pearlite of the steel wire for drawing is preferably set to 55 nm or greater.

<Measurement Method of Average Lamellar Spacing of Pearlite>

The average lamellar spacing of the pearlite in the steel wire for drawing according to the embodiment can be measured by the following method.

First, a transverse cross section of the steel wire for drawing is mirror-polished and is thereafter corroded by a picral, and 10 visual fields at arbitrary points are photographed at a magnification of 10,000-fold using a field emission scanning electron microscope (FE-SEM). The area per one visual field is $9.0\times10^{-5}$ $mm^2$ of 9 μm in length and 10 μm in width.

Next, among the taken photographs of the metallographic structures of the 10 visual fields, in a range in which the directions of lamellar in the visual fields are aligned, a plurality of points at which five lamellar spacings can be measured are selected. Regarding the plurality of points selected, a straight line is drawn perpendicularly to the major axis directions of the lamellar, and the length of five lamellar spacings is obtained. Next, among the plurality of points selected, two points are selected in an ascending order of the length of the five spacings. In addition, the length of the five lamellar spacings measured for each of the two points selected is divided by five, such that the lamellar spacing of each point can be obtained. That is, the lamellar spacings of two points can be obtained for each visual field. The average value of the lamellar spacings of the 10 visual fields obtained as described above, that is, a total of 20 points is determined as the average lamellar spacing of the pearlite of the steel wire for drawing.

<Average Length of Cementite in Pearlite: 2.0 μm to 5.0 μm>

In the steel wire for drawing according to the embodiment, in a case where the average length of cementite in the pearlite is smaller than 2.0 μm, breaking of the steel wire occurs, and drawing cannot be performed. Accordingly, the steel wire after drawing cannot secure a tensile strength of 4200 MPa or higher, and the occurrence of delamination in a torsion test of the steel wire after drawing cannot be suppressed. Therefore, the average length of the cementite in the pearlite is set to 2.0 μm or greater.

On the other hand, when the average length of the cementite in the pearlite is greater than 5.0 μm, a deterioration in the drawability of the steel wire for drawing becomes significant in the wet drawing process, which is the final drawing process. Therefore, the average length of the cementite in the pearlite is set to 5.0 μm or smaller. In addition, the average length of the cementite in the pearlite is preferably set to 4.0 μm or smaller.

In the steel wire for drawing according to the embodiment, even though other requirements are satisfied, in a case where the average length of the cementite in the pearlite is not in the range of 2.0 μm to 5.0 μm, the steel wire after drawing cannot achieve the compatibility between high strength and torsion properties.

<Ratio of Number of Grains of Cementite with Length of 0.5 μm or Smaller to Cementite in Pearlite: 20% or Lower>

In the steel wire for drawing according to the embodiment, when the ratio of the number of grains of cementite with a length of 0.5 μm or smaller to the cementite in the pearlite is higher than 20%, the steel wire after drawing cannot achieve the compatibility between a tensile strength of 4200 MPa or higher and torsion properties. Therefore, the ratio of the number of grains of cementite with a length of 0.5 μm or smaller to the cementite in the pearlite is set to 20% or lower.

In order to more stably achieve the high strength and the suppression of the occurrence of delamination in a torsion test to be compatible with each other, the ratio of the number of grains of cementite with a length of 0.5 μm or smaller to the cementite in the pearlite is preferably set to 15% or lower.

On the other hand, the lower limit of the ratio of the number of grains of cementite with a length of 0.5 μm or smaller to the cementite in the pearlite is not particularly limited. However, from the viewpoint of producing the steel wire for drawing industrially stably, the ratio of the number of grains of cementite with a length of 0.5 μm or smaller to the cementite in the pearlite is preferably set to 2% or more.

In the steel wire for drawing according to the embodiment, even though other requirements are satisfied, in a case where the ratio of the number of grains of cementite with a length of 0.5 μm or smaller to the cementite in the pearlite is not in the range of 20% or lower, the steel wire after drawing cannot achieve the compatibility between high strength and torsion properties.

<Measurement Method of Average Length of Cementite in Pearlite and Ratio of Number of Grains of Cementite with Length of 0.5 μm or Smaller to Cementite in Pearlite>

In the steel wire for drawing according to the embodiment, the average length of the cementite in the pearlite, and the ratio of the number of grains of cementite with a length of 0.5 μm or smaller to the cementite in the pearlite can be measured according to the following method.

Using the photographs from which the average lamellar spacing of the pearlite described above are obtained, straight lines are drawn along vertical directions and horizontal direction every 2 μm, and the lengths of cementite at the intersections of the straight lines are measured according to a typical method. Otherwise, in a case where there is no cementite at the intersections, the length of the closest grain of cementite is measured according to a typical method.

In addition, at 16 points per one photograph, the lengths of cementite are obtained, and the lengths of the cementite in the 10 photographs, that is, at a total of 160 points in 10 visual fields are obtained. The obtained lengths of the cementite at the total of 160 points are averaged, and the average value is determined as the average length of the cementite in the pearlite in the steel wire for drawing according to the embodiment. Here, the length of the cementite is defined as the major axis direction.

In addition, the ratio of the number of grains of cementite with a length of 0.5 μm or smaller to the cementite at the 160 points is determined as the ratio of the number of grains of cementite with a length of 0.5 μm or smaller to the cementite in the pearlite in the steel wire for drawing according to the embodiment.

By satisfying the above described chemical composition and metallographic structure, the steel wire for drawing which achieves the compatibility between high strength and torsion properties in the steel wire after drawing can be obtained. In order to obtain the above described steel wire for drawing, the steel wire for drawing may be produced according to a production method, which will be described later. Next, a preferable production method of the steel wire for drawing according to the embodiment will be described.

The steel wire for drawing according to the embodiment can be produced as follows. The production method of the steel wire for drawing described below is an example for obtaining the steel wire for drawing according to the embodiment and is not limited to the following order and method. Any method can be employed as long as the method can realize the configuration of the present invention.

In a case where the steel wire for drawing according to the embodiment is produced, the chemical compositions of steel, each process, and conditions in each process may be set such that the volume fraction of the pearlite, the average lamellar spacing of the pearlite, the average length of the cementite in the pearlite, the ratio of the number of grains of cementite with a length of 0.5 μm or smaller to the cementite in the pearlite reliably satisfy the above described conditions.

In addition, production conditions may be set depending on the wire diameter of the steel wire after drawing, and tensile strength and torsion properties to be needed.

First, steel is melted to have the above described chemical compositions. Thereafter, a steel piece is produced through continuous casting and is subjected to hot rolling. After the continuous casting, a cast steel may be rolled to a billet. When the obtained steel piece is hot rolled, the steel piece is heated by a general method so that the temperature of the central part of the steel piece is 1000° C. to 1100° C., and is hot rolled into ϕ4.0 mm to ϕ5.5 mm at a finish temperature of 900° C. to 1000° C.

After the finish rolling, as primary cooling, water cooling and forced air cooling using the air are combined with each other, and cooling is performed thereon to 750° C. to 700° C. at an average cooling rate of 50° C./s or faster.

After the primary cooling, a wire rod is cooled to 600° C. or less at an average cooling rate of 5° C./s to 15° C./s through forced air cooling using the air as secondary cooling.

A wire rod obtained as described above is subjected to descaling and a lubrication treatment in a typical method. Thereafter, the wire rod is subjected to dry cold drawing, thereby obtaining an intermediate steel wire of ϕ1.0 mm to ϕ2.0 mm.

Next, the intermediate steel wire is held for 5 seconds to 10 seconds in a heating furnace with an argon atmosphere at a temperature in a range of 975° C. to 1000° C., which is an austenite temperature region.

Then, within one second after the holding, the intermediate steel wire is immersed in a lead bath at 605° C. to 615° C. and is held for 7 seconds to 10 seconds so as to be subjected to a patenting treatment, and thereafter, lead is removed by a brush.

Last, by performing cooling to room temperature in the atmosphere, the steel wire for drawing according to the embodiment can be obtained.

The finish temperature of the hot rolling in the above described production method indicates the surface temperature of the wire rod immediately after the finish rolling. In addition, the cooling rate after the finish rolling indicates the cooling rate of the surface temperature of the wire rod.

The heating temperature in the heating furnace with the argon atmosphere indicates the surface temperature of the intermediate steel wire, and the temperature of the lead bath in the patenting treatment indicates the temperature of lead.

Here, in the above described production method, when the lead bath is used, the temperature of the lead bath in the patenting treatment is set to 605° C. to 615° C., which is higher than a general patenting treatment temperature of the related art.

Due to the patenting treatment, the metallographic structure in which the above described chemical compositions are satisfied, the volume fraction of the pearlite is 95% or higher, the average lamellar spacing of the pearlite is 50 nm to 75 nm, the average length of the cementite in the pearlite is 2.0 μm to 5.0 μm, and the ratio of the number of grains of cementite with a length of 0.5 μm or smaller to the cementite in the pearlite is 20% or lower can be reliably obtained.

However, it is needless to say that optimal patenting treatment conditions and other process conditions for reliably obtaining the metallographic structure described above vary depending on the chemical compositions of steel, processes to the patenting treatment, the history of heat treatments, and the like.

Hereinafter, the effects of the steel wire for drawing according to the embodiment will be described in more detail with reference to examples of the steel wire for drawing according to the embodiment. However, conditions in the examples are a conditional example employed to check the feasibility and effects of the present invention, and the present invention is not limited to the following examples. Appropriate modifications can be made in a scope adaptable to the gist without departing from the gist of the present invention as long as the object of the present invention is achieved. Therefore, the present invention can employ various conditions, and any of these belongs to the technical characteristics of the present invention.

EXAMPLES

Steels A to M having chemical compositions shown in Table 1 were melted in a converter and thereafter subjected to blooming in a typical method, thereby obtaining steel pieces of 122 mm square.

Next, the steel piece was heated so that the central part of the steel piece was 1050° C. to 1100° C., and thereafter hot rolled into ϕ5.0 mm at a finish temperature in a range of 900° C. to 950° C.

After the finish rolling, the steel piece was subjected to primary cooling, which was a combination of water cooling and forced air cooling using the air, to 730° C. to 700° C. at an average cooling rate in a range of 60° C./s to 80° C./s, and thereafter subjected to secondary cooling, through forced air cooling using the air, to a range of 600° C. to 550° C. at an average cooling rate in a range of 7° C./s to 12° C./s.

A wire rod obtained as described above was subjected to descaling and a lubrication treatment in a typical method, and was thereafter subjected to dry cold drawing, thereby obtaining an intermediate steel wire having a diameter of ϕ1.6 mm.

The intermediate steel wire obtained as described above was subjected to heat treatments including a patenting treatment under various conditions shown in (a) to (j) of Table 2.

That is, the intermediate steel wire was heated to a temperature described as "highest heating temperature" in Table 2. Next, the heated intermediate steel wire was held at a temperature in a range of 970° C. to 1000° C. for a holding time shown in Table 2. In addition, immediately, specifically, within 0.5 seconds to 0.8 seconds after the holding, the intermediate steel wire was immersed into the lead bath at a lead bath temperature shown in Table 2 for a time shown in Table 2 so as to be subjected to a patenting treatment, thereby producing a steel wire for drawing having a diameter of ϕ1.6 mm.

Regarding the steel wire for drawing produced under each of the conditions shown in Table 2, in the following method, the volume fraction of pearlite, the average lamellar spacing of the pearlite, the average length of cementite in the pearlite, and the ratio of the number of grains of cementite with a length of 0.5 μm or smaller to the cementite in the pearlite were obtained and shown in Tables 3-1-1 and 3-1-2.

A specific measurement method is as follows.

In the examples, the volume fraction of the pearlite in the steel wire for drawing was measured in the following method.

First, a transverse cross section of the steel wire for drawing, that is, a cut surface of the steel wire for drawing perpendicular to the length direction thereof was mirror-polished and was corroded by a picral, and 10 points at arbitrary position were photographed at a magnification of 5,000-fold using a field emission scanning electron microscope (FE-SEM). The area per one visual field was $3.6\times10^{-4}$ $mm^2$ of 18 μm in length and 20 μm in width. Next, the area fraction of the metallographic structure other than the pearlite was obtained through typical image analysis using the taken photographs. Since the area fraction is the same as the volume fraction, a value obtained by subtracting the area fraction of the metallographic structure other than the pearlite from 100 was determined as the volume fraction of the pearlite in the corresponding visual field. In addition, by averaging the volume fractions of pearlite in the obtained 10 visual fields, the volume fraction of the pearlite of the steel wire for drawing was obtained.

In the examples, the average lamellar spacing of the pearlite was measured in the following method.

First, a transverse cross section of the steel wire for drawing was mirror-polished and was thereafter corroded by a picral, and 10 visual fields at arbitrary points were photographed at a magnification of 10,000-fold using a field emission scanning electron microscope (FE-SEM). The area per one visual field was $9.0\times10^{-5}$ $mm^2$ of 9 μm in length and 10 μm in width.

Next, among the taken photographs of the metallographic structures of the 10 visual fields, in a range in which the directions of lamellar in the visual fields were aligned, a plurality of points at which five lamellar spacings could be measured were selected. Regarding the plurality of points selected, a straight line was drawn perpendicularly to the major axis directions of the lamellar, and the length of five lamellar spacings was obtained. Next, among the plurality of points selected, two points were selected in an ascending order of the length of the five spacings. In addition, the length of the five lamellar spacings measured for each of the two points selected was divided by five, such that the lamellar spacing of each point could be obtained. The average value of the lamellar spacings of the 10 visual fields obtained as described above, that is, a total of 20 points was determined as the average lamellar spacing of the pearlite of the steel wire for drawing.

In the examples, the average length of the cementite in the pearlite of the steel wire for drawing, and the ratio of the number of the grains of cementite with a length of 0.5 μm or smaller to the cementite in the pearlite were measured in the following method.

Using the photographs from which the average lamellar spacing of the pearlite described above were obtained, straight lines were drawn along vertical directions and horizontal direction every 2 μm, and the lengths of cementite at the intersections of the straight lines were measured according to a typical method. Otherwise, in a case where there is no cementite at the intersections, the length of the closest grain of cementite was measured according to a typical method.

In addition, at 16 points per one photograph, the lengths of cementite were obtained, and the lengths of the cementite in the 10 photographs, that is, at a total of 160 points in 10 visual fields were obtained. The obtained lengths of the cementite at the total of 160 points were averaged, and the average value was determined as the average length of the cementite in the pearlite in the steel wire for drawing. Here, the length of the cementite was defined as the major axis direction.

In addition, the ratio of the number of grains of cementite with a length of 0.5 μm or smaller to the cementite at the 160 points was determined as the ratio of the number of grains of cementite with a length of 0.5 μm or smaller to the cementite in the pearlite in the steel wire for drawing.

In order to evaluate the produced steel wire for drawing, by final wet drawing using the steel wire for drawing, a steel wire after drawing, that is, an extra fine steel wire was produced.

First, brass plating was subsequently performed on the steel wire for drawing after being subjected to the patenting treatment, in a typical method.

Next, wet drawing was performed thereon into a diameter of ϕ0.20 mm in a pass schedule in which the average of reduction of area in each die was 20%.

In addition, in the wet drawing, that is, the final drawing process, drawability was evaluated, and the results are shown in Tables 3-2-1 and 3-2-2. Specifically, the final drawing was performed on each of the steel wire for drawings for a weight of 50 kg, and the number of times of breaking of the steel wire during the final drawing was recorded. In a case where the number of times of breaking of the steel wire had reached 3, the wet drawing to a diameter of ϕ0.20 mm was stopped.

When the steel wire for drawing having a diameter of ϕ1.6 mm was subjected to the wet drawing into a diameter of ϕ0.20 mm for a weight of 50 kg, in a case where the number of times of breaking of the steel wire for drawing was 1 or less, the case was evaluated as "drawability is good". On the other hand, in a case where the number of times of breaking of the steel wire for drawing is 2 or more during the wet drawing, the case was evaluated as "drawability is poor".

Furthermore, the strength and torsion properties of the steel wire after the final drawing were measured in the following method. That is, a typical tensile test and a torsion test were conducted on the steel wire that was subjected to the wet drawing into a diameter of ϕ0.20 mm.

In addition, in the torsion test, a portion with a length of 100 times the wire diameter, that is, diameter was twisted at 15 rpm until the portion was broken, and whether or not delamination had occurred was determined by a torque curve. Each of the tests was conducted on 10 steel wires, and in a case where torque was reduced once even though breaking of the steel wire had not occurred, it was determined that "delamination had occurred" even in a single steel wire. The results are shown in Tables 3-2-1 and 3-2-2.

In addition, the target performance of the steel wire which was formed of the steel wire for drawing of the present invention and was subjected to the wet drawing is that the number of times of breaking of the steel wire was 1 or less when the steel wire for drawing having a diameter of ϕ1.6 mm is subjected to the wet drawing into a diameter of ϕ0.20 mm for a weight of 50 kg, the tensile strength after the wet drawing was 4200 MPa or higher, preferably 4350 MPa or higher, and more preferably 4450 MPa or higher, and delamination had never occurred when the torsion test was conducted on 10 steel wires.

Regarding the target performance of the extra fine steel wire after the final drawing, a case where the tensile strength was 4200 MPa or higher was evaluated as "target performance is sufficient", and a case where a tensile strength of 4200 MPa or higher was not satisfied was evaluated as "target performance is insufficient".

In addition, regarding the target performance of the extra fine steel wire after the final drawing, a case where delamination had never occurred in the torsion test was evaluated as "torsion properties are good", and a case where delamination had ever occurred was determined as "torsion properties are poor".

TABLE 1

| Steel | Chemical composition [unit: mass %] C | Si | Mn | P | S | Cr | Mo | Al | B | N | Note |
|---|---|---|---|---|---|---|---|---|---|---|---|
| A | 0.83 | 0.21 | 0.31 | 0.008 | 0.005 | 0.23 | — | 0.0009 | — | 0.0038 | Comparative Example |
| B | 0.90 | 0.20 | 0.31 | 0.010 | 0.009 | 0.22 | — | 0.0012 | — | 0.0033 | Present Invention Example |
| C | 1.02 | 0.21 | 0.32 | 0.009 | 0.004 | 0.21 | — | 0.0008 | — | 0.0035 | Present Invention Example |
| D | 1.07 | 0.22 | 0.34 | 0.010 | 0.005 | 0.21 | — | 0.0007 | — | 0.0028 | Present Invention Example |
| E | 1.25 | 0.21 | 0.32 | 0.011 | 0.006 | 0.21 | — | 0.0006 | — | 0.0039 | Comparative Example |
| F | 0.90 | 0.22 | 0.31 | 0.012 | 0.008 | 0.13 | — | 0.0011 | — | 0.0045 | Comparative Example |
| G | 1.12 | 0.51 | 0.30 | 0.010 | 0.006 | 0.21 | — | 0.0009 | — | 0.0056 | Present Invention Example |
| H | 1.02 | 0.21 | 0.31 | 0.009 | 0.007 | 0.51 | — | 0.0007 | — | 0.0034 | Present Invention Example |
| I | 1.02 | 0.20 | 0.30 | 0.007 | 0.008 | 0.68 | — | 0.0009 | — | 0.0036 | Comparative Example |
| J | 1.07 | 0.21 | 0.31 | 0.009 | 0.007 | 0.22 | 0.07 | 0.0010 | — | 0.0044 | Present Invention Example |
| K | 1.02 | 0.22 | 0.32 | 0.007 | 0.006 | 0.22 | — | 0.0008 | 0.0014 | 0.0029 | Present Invention Example |
| L | 1.03 | 1.08 | 0.31 | 0.008 | 0.007 | 0.21 | — | 0.0009 | — | 0.0032 | Comparative Example |
| M | 1.03 | 0.21 | 1.06 | 0.008 | 0.006 | 0.20 | — | 0.0008 | — | 0.0031 | Comparative Example |

* The underlined indicate outside of the ranges of the present invention.
* The remainder is Fe and impurities.

TABLE 2

| Heat treatment condition symbol | Highest heating temperature (° C.) | Holding time at 970° C. to 1000° C. (sec) | Lead bath temperature (° C.) | Lead bath immersion time (sec) |
|---|---|---|---|---|
| (a) | 990 | 7 | 550 | 10 |
| (b) | 990 | 7 | 570 | 8 |
| (c) | 990 | 7 | 605 | 8 |
| (d) | 990 | 7 | 615 | 8 |
| (e) | 990 | 7 | 630 | 8 |
| (f) | 990 | 7 | 605 | 4 |
| (g) | 990 | 7 | 605 | 20 |
| (h) | 950 | 0 | 605 | 8 |
| (i) | 1040 | 7 | 610 | 8 |
| (j) | 990 | 30 | 610 | 8 |

TABLE 3-1-1

| Test No. | Steel | Heat treatment condition symbol | Before final drawing Steel wire for drawing: Volume fraction of pearlite (%) | Average lamellar spacing of pearlite (nm) | Average length of cementite in pearlite (μm) |
|---|---|---|---|---|---|
| 1 | A | (c) | 98 | 72 | 3.7 |
| 2 | B | (c) | 100 | 67 | 3.6 |
| 3 | C | (a) | 75 | 58 | 1.4 |
| 4 | C | (b) | 97 | 60 | 1.8 |
| 5 | C | (c) | 99 | 64 | 3.4 |
| 6 | C | (d) | 100 | 66 | 3.9 |
| 7 | C | (e) | 99 | 78 | 4.2 |
| 8 | C | (f) | 82 | 64 | 2.7 |
| 9 | C | (g) | 99 | 65 | 2.5 |
| 10 | C | (h) | 97 | 66 | 2.7 |
| 11 | C | (i) | 100 | 63 | 5.8 |
| 12 | C | (l) | 99 | 63 | 5.7 |
| 13 | D | (a) | 73 | 52 | 1.3 |
| 14 | D | (b) | 97 | 54 | 1.7 |
| 15 | D | (c) | 98 | 58 | 2.8 |

TABLE 3-1-1-continued

| Test No. | Steel | Heat treatment condition symbol | Before final drawing Steel wire for drawing: Volume fraction of pearlite (%) | Average lamellar spacing of pearlite (nm) | Average length of cementite in pearlite (μm) |
|---|---|---|---|---|---|
| 16 | D | (d) | 99 | 62 | 3.4 |
| 17 | D | (e) | 99 | 76 | 3.8 |
| 18 | D | (f) | 79 | 57 | 2.6 |
| 19 | D | (g) | 98 | 60 | 2.4 |
| 20 | D | (h) | 96 | 60 | 2.4 |
| 21 | D | (i) | 100 | 59 | 5.6 |
| 22 | D | (l) | 100 | 60 | 5.5 |
| 23 | E | (c) | 97 | 55 | 2.5 |
| 24 | F | (b) | 98 | 64 | 1.9 |
| 25 | F | (c) | 99 | 70 | 3.7 |
| 26 | G | (d) | 99 | 60 | 3.0 |
| 27 | G | (h) | 96 | 62 | 2.3 |
| 28 | H | (a) | 74 | 48 | 1.2 |
| 29 | H | (b) | 97 | 52 | 1.6 |
| 30 | H | (c) | 98 | 55 | 2.8 |
| 31 | H | (d) | 99 | 57 | 3.2 |
| 32 | I | (b) | 97 | 49 | 2.1 |
| 33 | I | (c) | 98 | 54 | 2.5 |
| 34 | J | (c) | 97 | 56 | 2.1 |
| 35 | J | (f) | 68 | 51 | 2.2 |
| 36 | K | (c) | 98 | 63 | 3.5 |
| 37 | L | (c) | 96 | 61 | 3.2 |
| 38 | M | (c) | 95 | 60 | 2.9 |

* The underlined indicate outside of the ranges of the present invention.

TABLE 3-1-2

| Test No. | Steel | Heat treatment condition symbol | Before final drawing Steel wire for drawing Ratio of number of grains of cementite with length of 0.5 μm or smaller (%) | Note |
|---|---|---|---|---|
| 1 | A | (c) | 4 | Comparative Example |
| 2 | B | (c) | 6 | Present Invention Example |
| 3 | C | (a) | 24 | Comparative Example |
| 4 | C | (b) | 15 | Comparative Example |
| 5 | C | (c) | 6 | Present Invention Example |
| 6 | C | (d) | 4 | Present Invention Example |
| 7 | C | (e) | 2 | Comparative Example |
| 8 | C | (f) | 14 | Comparative Example |
| 9 | C | (g) | 28 | Comparative Example |
| 10 | C | (h) | 22 | Comparative Example |
| 11 | C | (i) | 4 | Comparative Example |
| 12 | C | (i) | 5 | Comparative Example |
| 13 | D | (a) | 26 | Comparative Example |
| 14 | D | (b) | 16 | Comparative Example |
| 15 | D | (c) | 8 | Present Invention Example |
| 16 | D | (d) | 7 | Present Invention Example |
| 17 | D | (e) | 4 | Comparative Example |
| 18 | D | (f) | 16 | Comparative Example |
| 19 | D | (g) | 27 | Comparative Example |
| 20 | D | (h) | 26 | Comparative Example |
| 21 | D | (i) | 7 | Comparative Example |
| 22 | D | (i) | 5 | Comparative Example |
| 23 | E | (c) | 10 | Comparative Example |
| 24 | F | (b) | 13 | Comparative Example |
| 25 | F | (c) | 5 | Comparative Example |
| 26 | G | (d) | 11 | Present Invention Example |
| 27 | G | (h) | 31 | Comparative Example |
| 28 | H | (a) | 28 | Comparative Example |
| 29 | H | (b) | 17 | Comparative Example |
| 30 | H | (c) | 11 | Present Invention Example |

TABLE 3-1-2-continued

| Test No. | Steel | Heat treatment condition symbol | Before final drawing Steel wire for drawing Ratio of number of grains of cementite with length of 0.5 μm or smaller (%) | Note |
|---|---|---|---|---|
| 31 | H | (d) | 9 | Present Invention Example |
| 32 | I | (b) | 18 | Comparative Example |
| 33 | I | (c) | 13 | Comparative Example |
| 34 | J | (c) | 10 | Present Invention Example |
| 35 | J | (f) | 22 | Comparative Example |
| 36 | K | (c) | 5 | Present Invention Example |
| 37 | L | (c) | 11 | Comparative Example |
| 38 | M | (c) | 10 | Comparative Example |

* The underlined indicate outside of the ranges of the present invention.

TABLE 3-2-1

| Test No. | Steel | Heat treatment condition symbol | Final drawing: Number of times of breaking of steel wire during wet drawing from ϕ1.6 mm to ϕ0.20 mm (times) | Drawability (—) |
|---|---|---|---|---|
| 1 | A | (c) | 0 | Good |
| 2 | B | (c) | 0 | Good |
| 3 | C | (a) | 2 | Poor |
| 4 | C | (b) | 1 | Good |
| 5 | C | (c) | 0 | Good |
| 6 | C | (d) | 0 | Good |
| 7 | C | (e) | 0 | Good |
| 8 | C | (f) | 1 | Good |
| 9 | C | (g) | 0 | Good |
| 10 | C | (h) | 1 | Good |
| 11 | C | (i) | 3*[1] | Poor |
| 12 | C | (j) | 3*[1] | Poor |
| 13 | D | (a) | 3*[1] | Poor |
| 14 | D | (b) | 2 | Poor |
| 15 | D | (c) | 0 | Good |
| 16 | D | (d) | 0 | Good |
| 17 | D | (e) | 0 | Good |
| 18 | D | (f) | 2 | Poor |
| 19 | D | (g) | 1 | Good |
| 20 | D | (h) | 2 | Poor |
| 21 | D | (i) | 3*[1] | Poor |
| 22 | D | (j) | 3*[1] | Poor |
| 23 | E | (c) | 3*[1] | Poor |
| 24 | F | (b) | 1 | Good |
| 25 | F | (c) | 0 | Good |
| 26 | G | (d) | 1 | Good |
| 27 | G | (h) | 3*[1] | Poor |
| 28 | H | (a) | 3*[1] | Poor |
| 29 | H | (b) | 2 | Poor |
| 30 | H | (c) | 1 | Good |
| 31 | H | (d) | 0 | Good |
| 32 | I | (b) | 3*[1] | Poor |
| 33 | I | (c) | 2 | Poor |
| 34 | J | (c) | 0 | Good |
| 35 | J | (f) | 2 | Poor |
| 36 | K | (c) | 0 | Good |
| 37 | L | (c) | 1 | Good |
| 38 | M | (c) | 3*[1] | Poor |

*The underlined indicate outside of the ranges of the present invention.

*[1]Since the number of times of breaking of the steel wire was 3, wet drawing was stopped.

TABLE 3-2-2

| Test No. | Steel | Heat treatment condition symbol | After final drawing Extra fine steel wire: Tensile strength (MPa) | Target performance Tensile strength (—) | Number of times of delamination in torsion test (times) | Target performance Torsion properties (—) | Note |
|---|---|---|---|---|---|---|---|
| 1 | A | (c) | 4034 | Insufficient | 0 | Good | Comparative Example |
| 2 | B | (c) | 4215 | Sufficient | 0 | Good | Present Invention Example |
| 3 | C | (a) | 4310 | Sufficient | 8 | Poor | Comparative Example |
| 4 | C | (b) | 4397 | Sufficient | 6 | Poor | Comparative Example |
| 5 | C | (c) | 4356 | Sufficient | 0 | Good | Present Invention Example |
| 6 | C | (d) | 4312 | Sufficient | 0 | Good | Present Invention Example |
| 7 | C | (e) | 4086 | Insufficient | 0 | Good | Comparative Example |
| 8 | C | (f) | 4288 | Sufficient | 3 | Poor | Comparative Example |
| 9 | C | (g) | 4305 | Sufficient | 3 | Poor | Comparative Example |
| 10 | C | (h) | 4271 | Sufficient | 2 | Poor | Comparative Example |
| 11 | C | (i) | — | — | — | — | Comparative Example |
| 12 | C | (j) | — | — | — | — | Comparative Example |
| 13 | D | (a) | — | — | — | — | Comparative Example |
| 14 | D | (b) | 4623 | Sufficient | 10 | Poor | Comparative Example |
| 15 | D | (c) | 4582 | Sufficient | 0 | Good | Present Invention Example |
| 16 | D | (d) | 4505 | Sufficient | 0 | Good | Present Invention Example |
| 17 | D | (e) | 4193 | Insufficient | 0 | Good | Comparative Example |
| 18 | D | (f) | 4489 | Sufficient | 5 | Poor | Comparative Example |
| 19 | D | (g) | 4534 | Sufficient | 6 | Poor | Comparative Example |
| 20 | D | (h) | 4488 | Sufficient | 10 | Poor | Comparative Example |
| 21 | D | (i) | — | — | — | — | Comparative Example |
| 22 | D | (j) | — | — | — | — | Comparative Example |
| 23 | E | (c) | — | — | — | — | Comparative Example |
| 24 | F | (b) | 4186 | Insufficient | 4 | Poor | Comparative Example |
| 25 | F | (c) | 4128 | Insufficient | 0 | Good | Comparative Example |
| 26 | G | (d) | 4705 | Sufficient | 0 | Good | Present Invention Example |
| 27 | G | (h) | — | — | — | — | Comparative Example |
| 28 | H | (a) | — | — | — | — | Comparative Example |
| 29 | H | (b) | 4571 | Sufficient | 5 | Poor | Comparative Example |
| 30 | H | (c) | 4520 | Sufficient | 0 | Good | Present Invention Example |
| 31 | H | (d) | 4488 | Sufficient | 0 | Good | Present Invention Example |
| 32 | I | (b) | — | — | — | — | Comparative Example |
| 33 | I | (c) | 4595 | Sufficient | 10 | Poor | Comparative Example |
| 34 | J | (c) | 4702 | Sufficient | 0 | Good | Present Invention Example |
| 35 | J | (f) | 4519 | Sufficient | 5 | Poor | Comparative Example |
| 36 | K | (c) | 4391 | Sufficient | 0 | Good | Present Invention Example |
| 37 | L | (c) | 4365 | Sufficient | 4 | Poor | Comparative Example |
| 38 | M | (c) | — | — | — | — | Comparative Example |

* The underlined indicate outside of the ranges of the present invention.

From Tables 3-1-1, 3-1-2, 3-2-1 and 3-2-2, regarding Test Nos. 11 to 13, 21 to 23, 27, 28, 32, and 38, which were deviated from the conditions specified in the present invention, three or more times of breaking had occurred in the final drawing, that is, the final wet drawing. Therefore, the final drawing was stopped.

In addition, regarding Test Nos. 1, 7, 17, 24, and 25, which were deviated from the conditions specified in the present invention, although the final drawing could be performed, the tensile strength after the final drawing did not reach 4200 MPa.

In addition, in Test Nos. 3, 4, 8 to 10, 14, 18 to 20, 29, 33, 35, and 37, which were deviated from the conditions specified in the present invention, although the final drawing could be performed and the tensile strength had reached 4200 MPa after the final drawing, one or more times of delamination occurred in the torsion test.

Contrary to this, Test Numbers that satisfied the conditions specified in the present invention, breaking of the steel wire had occurred only one or less during the final drawing, that is, the final wet drawing, and the tensile strength after the final drawing achieved 4200 MPa or higher. In addition, delamination never occurred in the torsion test.

While the preferred embodiment and the examples of the present invention have been described above, the embodiment and the examples are merely examples in the scope of the gist of the present invention, and additions, omissions, substitutions, and other changes of the configuration can be made without departing from the gist of the present invention. That is, it is natural that the present invention is not limited to the above description and is limited only by the appended claims, and appropriate changes can be made in the scope thereof

INDUSTRIAL APPLICABILITY

According to the present invention, a steel wire for drawing which is used as the material of a high strength steel wire having a small diameter, which is appropriately used as a steel cord or a sawing wire and has high strength and excellent torsion properties, can be obtained, and the steel wire for drawing can be stably produced with high productivity, which very significantly contributes to the industry.

The invention claimed is:

1. A steel wire for drawing comprising, as a chemical composition, by mass %, C: 0.9% to 1.2%, Si: 0.1% to 1.0%, Mn: 0.2% to 1.0%, Cr: 0.2% to 0.6%, Al: limited to 0.002% or less, N: limited to 0.007% or less, P: limited to 0.02% or less, S: limited to 0.01% or less, and one or more selected from the group consisting of Mo: 0% to 0.20%, and B: 0% to 0.0030%, and a remainder of Fe and impurities, wherein a metallographic structure includes a pearlite, and a volume fraction of the pearlite is 95% or higher, an average lamellar spacing of the pearlite is 50 nm to 75 nm, an average length of cementite in the pearlite is 2.0 μm to 5.0 μm, and a ratio of the number of grains of cementite with a length of 0.5 μm or smaller to the cementite in the pearlite is 20% or lower.

2. The steel wire for drawing according to claim 1, comprising, as the chemical composition, by mass %, one or more selected from the group consisting of Mo: 0.02% to 0.20%, and B: 0.0005% to 0.0030%.

* * * * *